US005803777A

United States Patent [19]

Hiraoka

[11] Patent Number: 5,803,777

[45] Date of Patent: Sep. 8, 1998

[54] LATCH FOR OUTBOARD MOTOR PROTECTIVE COWLING

[75] Inventor: Noriyoshi Hiraoka, Hamamatsu, Japan

[73] Assignee: Sanshin Kogyo Kabushiki Kaisha, Hamamatsu, Japan

[21] Appl. No.: 624,881

[22] Filed: Mar. 27, 1996

[30] Foreign Application Priority Data

Mar. 28, 1995 [JP] Japan ..... 7-094402

[51] Int. Cl.[6] ..... B63H 21/26

[52] U.S. Cl. ..... 440/77; 123/195 P; 292/121; 292/128; 292/129

[58] Field of Search ..... 440/77; 123/195 P, 123/195 C; 292/121, 129, 219, 229, 128

[56] References Cited

U.S. PATENT DOCUMENTS

| | | | |
|---|---|---|---|
| 2,288,926 | 7/1942 | Strader | 292/121 |
| 4,871,333 | 10/1989 | Curtis et al. | 440/77 |
| 4,875,883 | 10/1989 | Slattery | 440/77 |
| 4,927,194 | 5/1990 | Wagner | 440/77 |
| 4,971,587 | 11/1990 | Uchida et al. | 292/128 |
| 5,096,447 | 3/1992 | Uehara | 440/55 |
| 5,120,248 | 6/1992 | Daleiden et al. | 440/77 |
| 5,145,423 | 9/1992 | Kawai | 440/63 |
| 5,338,236 | 8/1994 | Dunham et al. | 440/77 |

*Primary Examiner*—Sherman Basinger
*Attorney, Agent, or Firm*—Knobbe, Martens, Olson & Bear, LLP

[57] ABSTRACT

A latching assembly for engaging and disengaging an upper cover portion and lower tray portion of a cowling of an outboard engine. The lower tray portion includes a recess in which part of the latching assembly is located. The latching assembly includes a shaft mounted to the lower tray portion. A latch is rotatably secured to the shaft and movable between an engaged and a disengaged position. The latch is disposed within the recess when engaged so that is is flush with the exterior of the cowling. A catch is mounted to the upper cover portion and is engageable by the latch hook. A mechanism for biasing the latch to the engaged or disengaged position is provided for preventing the latch from moving from the engaged or disengaged position.

15 Claims, 6 Drawing Sheets

LATCH FOR OUTBOARD MOTOR PROTECTIVE COWLING

BACKGROUND OF THE INVENTION

The present invention relates to a latching assembly for a cowling of an outboard motor. More particularly, the invention pertains to a latching assembly including a latch, catch and biasing means for connecting and disconnecting the upper cover and lower tray portion of a cowling for the power head of an outboard motor.

It is well known in the art of outboard motors that the powering internal combustion engine is normally enclosed within a cowling so as to provide protection for the engine and user, reduce noise from the engine and provide a nicer appearance for the outboard motor. The protective cowling defines a cavity in which the internal combustion engine is contained. In a typical outboard motor, a "bucket style" cowling is used to contain the engine and includes a lower tray portion and an upper cover portion that is removable so that the engine can be serviced. Latch assemblies are used for securing the upper cover and lower tray portions of the cowling together.

It is desirable to conceal these latch assemblies in the cowling because protrusion of the latch assemblies causes interference with foreign objects, such as tow ropes, especially upon rotation of the outboard engine. Additionally, concealing the latch assemblies enhances the style of the cowling design.

Along with the benefits of concealing the latch assemblies, it is advantageous to provide a latching assembly that effectively retains the cowling in a locked positon without accidental disengagement caused from sudden forces experienced by the outboard engine upon the sudden and forceful striking of an underwater obstacle.

In the past, non-protruding latching assemblies for "bucket style" cowlings have been designed with means to prevent accidental disengagement of the latching assembly. However, these latching assemblies have not been designed with means to prevent accidental engagement of the latching assembly. It is important to prevent accidental engagement of the latching assembly in order to avoid interference of the latching assembly with placement of the upper portion on the lower portion of the cowling. Furthermore, these latching assemblies have not been designed with biasing for forcing the latching assembly into an engaged position for further protection against accidental disengagement of the latching assembly.

It is therefore an object of this invention to provide a latching assembly with a biasing means that is specifically configured to prevent the latching assembly from accidentally becoming engaged or disengaged by whatever cause.

It is a further object of this invention to provide a latching assembly including an operating handle that is disposed within a recess of the cowling during engagement of the latching assembly so as to effectively conceal the operating handle, thereby eliminating the problems associated with an obtruding latching assembly.

SUMMARY OF THE INVENTION

The invention comprises a latching assembly for engaging and disengaging an upper cover portion and lower tray portion of a cowling of an outboard engine. The lower tray portion includes a recess in which part of the latching assembly is located. The latching assembly includes a shaft mounted to the lower tray portion. A latch is rotatably secured to the shaft and movable between an engaged and a disengaged position. The latch is disposed within the recess when engaged so that is is flush with the exterior of the cowling. A catch is mounted to the upper cover portion and is engageable by the latch hook. A means for biasing the latch to the engaged or disengaged position is provided for preventing the latch from moving from the engaged or disengaged position.

DETAILED DESCRIPTION OF THE PREFERRED EMBODIMENTS

Figure 1:
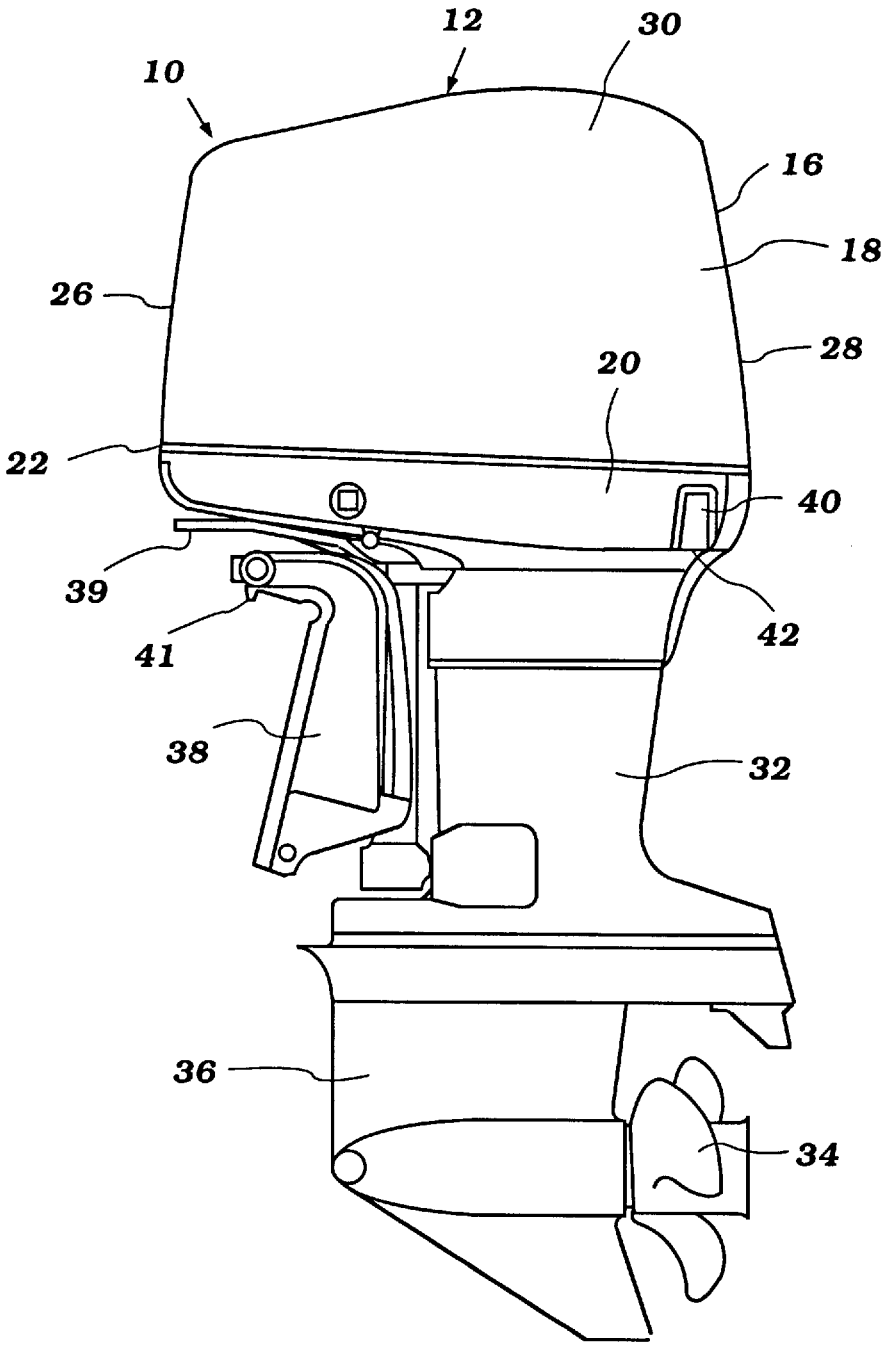
FIG. 1 is a side elevational view of an outboard motor constructed in accordance with the invention.
Figure 2:
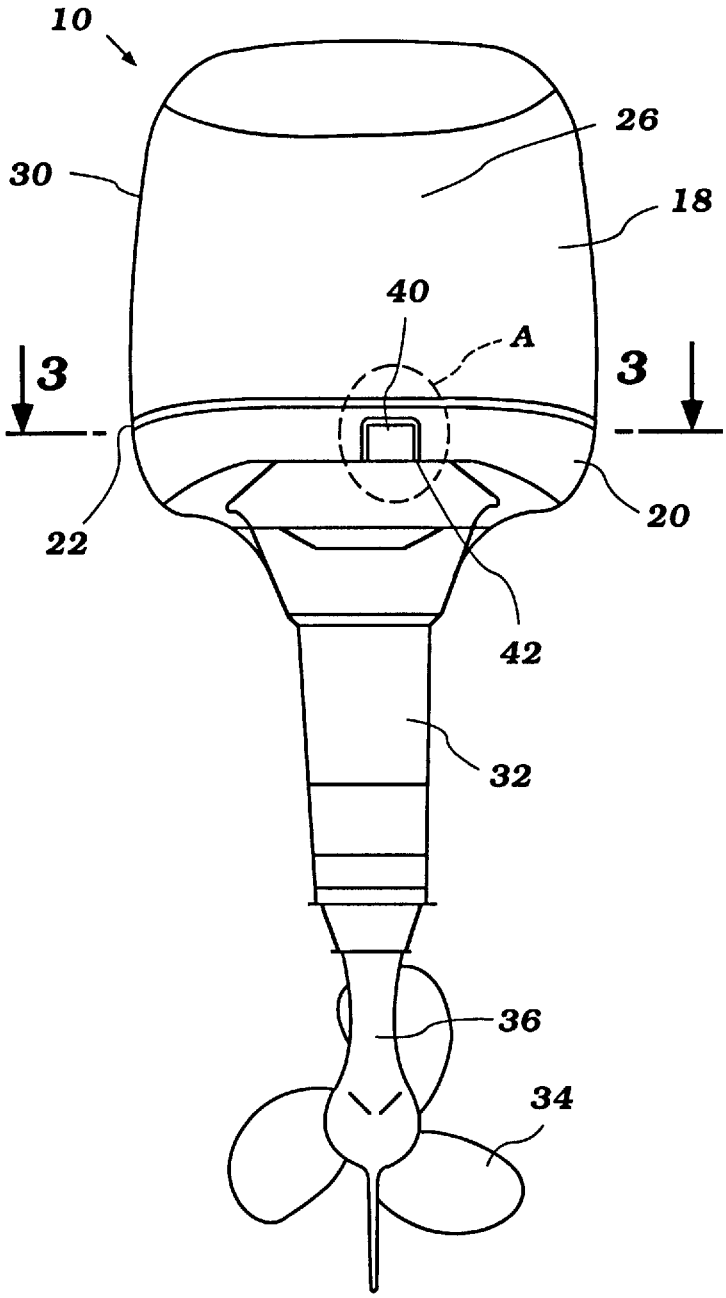
FIG. 2 is a front elevational view of the outboard motor constructed in accordance with the invention.
Figure 3:
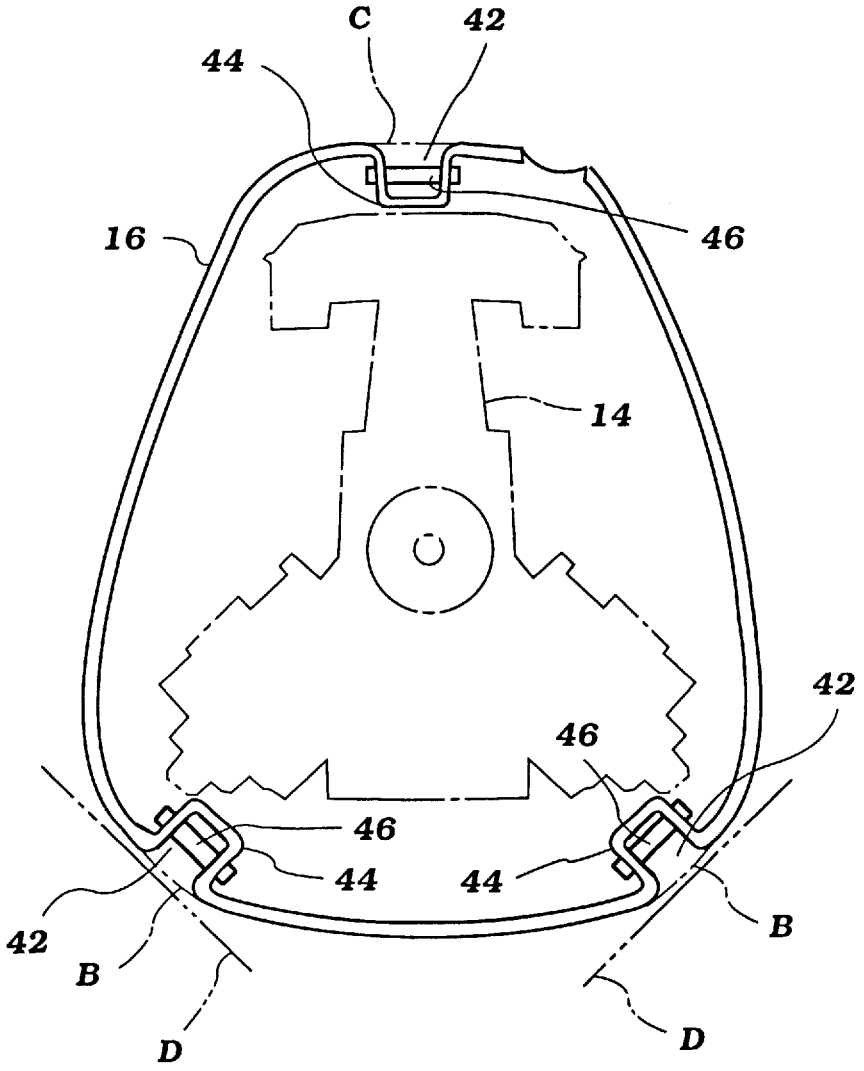
FIG. 3 is a sectional view along 3—3 of FIG. 2.

Referring to FIGS. 1 through 3, an outboard motor constructed in accordance with the invention is identified generally by the reference numeral 10. The outboard motor includes a power head, indicated generally by the reference numeral 12, which contains an internal combustion engine 14 surrounded by a protective cowling 16 having an upper cover portion 18 and a lower tray portion 20. The upper cover portion 18 is preferably made of fiberglass-reinforced plastic and the lower tray portion 20 is made of aluminum or aluminum alloy. A rubber seal 22 is affixed to a lip 24 of the upper cover portion 18 to maintain a water-tight seal when the upper cover and lower tray portions of the cowling 16 are locked together. The protective cowling has a front face 26, rear face 28 and opposite sides 30. The internal combustion engine may be of any known type and drives an output shaft (not shown), which in turn drives a drive shaft (not shown) that is journaled for rotation within a drive shaft housing 32 that depends from the power head 12. This drive shaft drives a propeller 34 of a lower unit 36 by means of a conventional forward/reverse/neutral transmission (not shown).

The outboard motor 10 is mounted to the transom of a boat by a transom-mounting bracket 38. A steering shaft (not shown) is affixed to the drive shaft housing 32 in a well-known manner and a steering tiller 39 is provided for steering the outboard motor 10. The outboard motor 10 is pivotally connected to the transom mounting bracket 38 through a tilt shaft 41 for tilt and trim movement of the outboard motor 10.

The construction of the outboard motor as thus far described may be considered conventional. Thus, those components which are not illustrated and which have not been described in any more detail may take the form of any known components used in this field.

Figure 4:
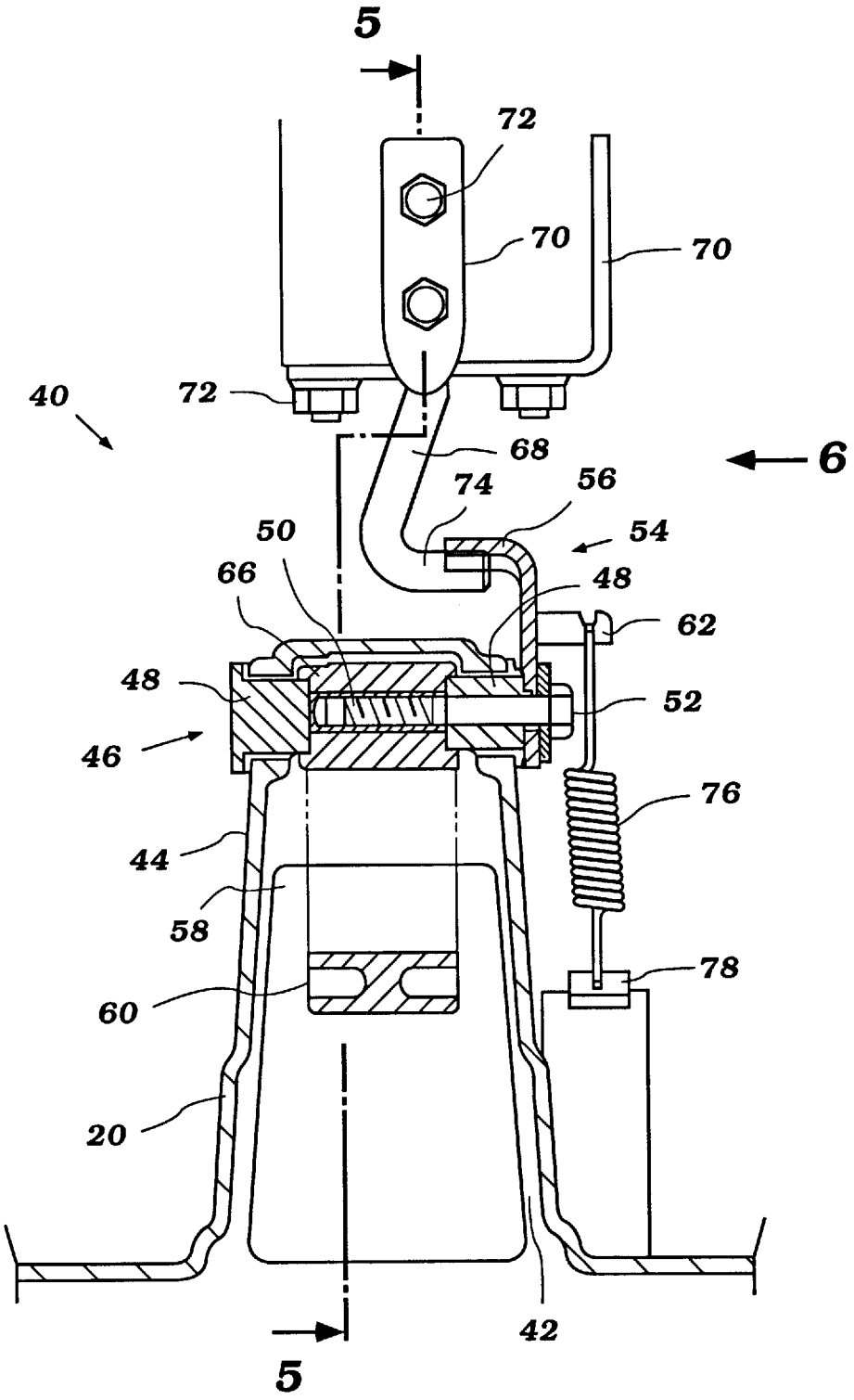
FIG. 4 is an enlarged cross-sectional view of the portion A of FIG. 2 from the inside of the power head looking out.
Figure 5:
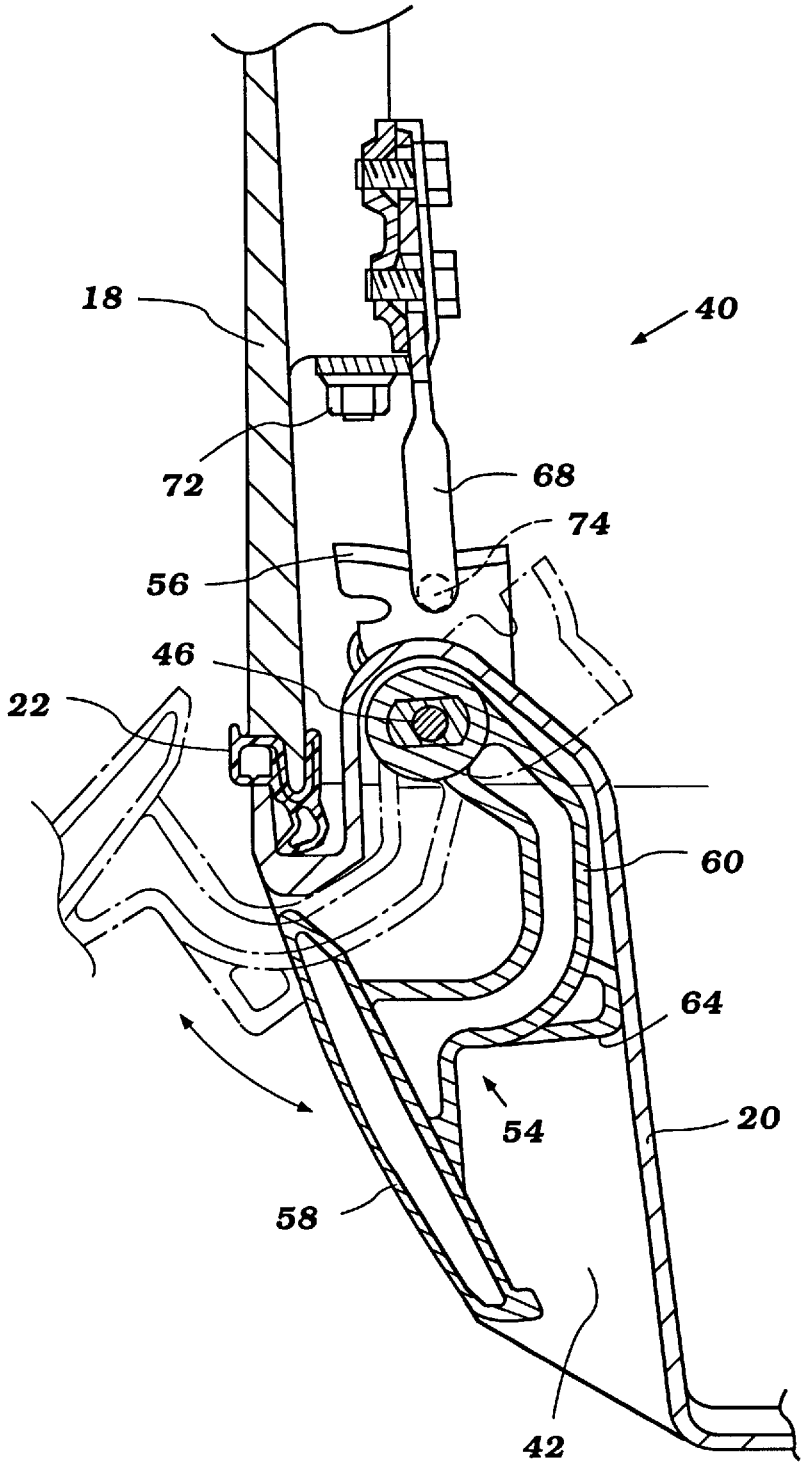
FIG. 5 is a left side view of FIG. 4

In accordance with the present invention, a plurality of latching assemblies, indicated generally by the reference numeral 40, are provided for engaging and disengaging the upper cover and lower tray portions of the cowling, 18 and 20, respectively. Each latching assembly 40 is partially disposed within a respective one of three recesses 42 provided near the junction of the upper cover 18 and lower tray 20 portions. As best shown in FIG. 3, the latching assemblies are located at rounded areas B where the sides 30 merge with the rear face 28 at opposite ends of the rear face 28 and at area C near the center of the front face 26. Lines D are tangent lines of the center surface points of the rear latching assemblies. The location and number of latching assemblies 40 described is preferred for securing the upper cover 18 and lower tray 20 portions together and for preventing interference between the latch assemblies 40 and a tow rope, or other foreign object, upon rotation of the outboard motor 10 about a vertical axis. However, it will be apparent to those skilled in the art that other latching assembly locations and numbers may be used without detracting from the spirit of the present invention. As best shown in FIGS. 4 and 5, a latch bridge 44 is formed in the lower tray portion 20 by each recess 42.

Figure 6:
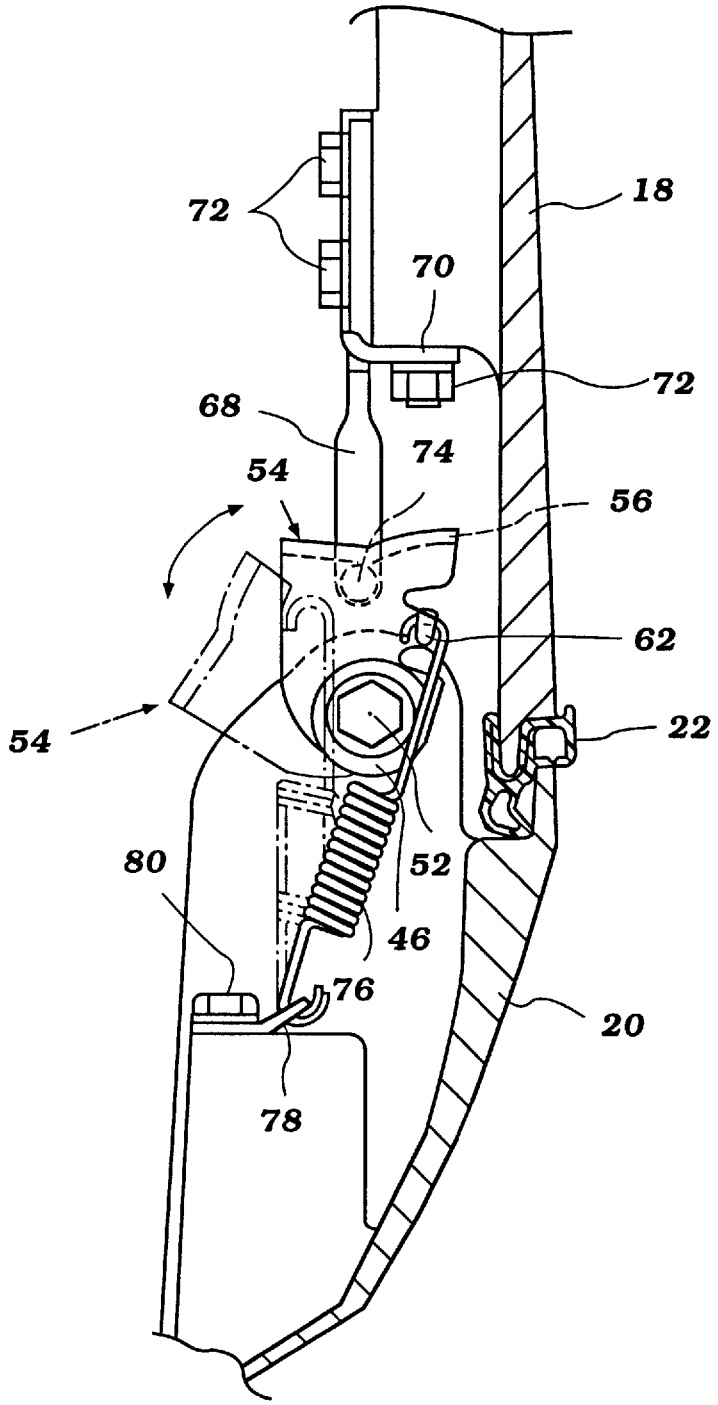
FIG. 6 is a right side view of FIG. 4.

Referring in detail to FIGS. 4 through 6, the latching assembly 40 includes a horizontal shaft 46 journalled in opposite sides of the latch bridge 44 of the lower tray portion 20 of the cowling. The shaft 46 includes opposite shaft ends 48 connected by a shaft center 50. The shaft elements are joined and mounted to the bridge 44 by a shaft screw 52.

The latch assembly 40 includes a latch 54 rotatably secured to the horizontal shaft 46 for operation of the latch assembly 40. The latch 54 includes a generally L-shaped extended hook 56 for retaining a catch, to be described, and is connected to a handle 58 through a curved arm 60. A spring support 62 extends horizontally from the latch hook 56 for connecting a helical spring, to be described. A stopper 64 (FIG. 5) extends from the latch arm 60 to prevent rotation of the latch 54 past an engaged position. The latch 54 is rotatably secured to the horizontal shaft 46 at a collar 66 (FIG. 4) formed by the junction of the arm 60 and the hook 56.

The latch handle 58 has a generally rectangular shape and a thickness that tapers at upper and lower ends of the handle 58. At the lower end of the handle 58, this taper facilitates gripping of the handle 58 for operation purposes. When the latch 54 is fully engaged, the handle 58 is disposed in the lower tray recess 42 and the exterior of the handle 58 is flush with the exterior of the cowling 16. The flush exterior of the cowling 16 and the handle 58 enhances the smooth styling of the cowling exterior and prevents obtrusion of the handle 58 when engaged and the problems associated therewith, such as interference with shirt sleeves, tow ropes and other foreign objects.

The latching assembly 40 further includes a catch 68 that is engageable by the latch 54 previously described in order to connect the upper cover 18 and lower tray 20 of the cowling. The catch 68 is attached to the upper cover portion 18 through a mounting bracket 70 and a plurality of bolts 72. A generally J-shaped catch hook 74 extends from the catch 68 for engagement with the latch hook 56 of the latch 54.

The latching assembly 40 includes a means for biasing the latch 54 to a fully engaged or disengaged position. This means for biasing preferably takes the form of a helical spring 76 connecting the support 62 of the latch hook to the lower tray portion 20. The spring 76 is connected to the lower tray portion 20 through a mounting bracket 78 and bolt 80. The spring 76 is specifically positioned so that the greatest tensile force in the spring 76 is found when the latch hook 56 is rotated to a point intermediate to the engaged and disengaged positions. The tension in the spring 76 forces and retains the latch 54 in either a fully engaged or disengaged position, absent some interference by a user. It will be apparent to those skilled in the art that other biasing means, such as a magnetic arrangement, may be used to achieve the same purpose as the helical springs 76.

In use, the latch assembly 40 may be engaged or disengaged. When engaged, the upper cover portion 18 and lower tray portion 20 of the cowling are connected. When disengaged, the upper cover portion 18 is removed from the lower tray portion 20 of the cowling 16 for maintenance of the internal combustion engine 14.

To connect the upper cover portion 18 to the lower tray portion 20 of the cowling, the upper cover portion 18 is placed on the lower tray portion 20 so that the seal 22 of the upper tray portion 18 is in a good fit with the lower tray portion 20. A user pushes the latch handle 58 into the lower tray recess 42 until the stopper 64 on the latch arm prevents further rotation of the latch 54. In turn, the L-shaped latch hook 56 rotates, engages and covers the catch hook 74 preventing removal of the upper cover portion 18. Once the latch hook 56 rotates to a position where is covers the catch hook 74, the biasing means provides a force that facilitates full engagement of the latch 54. The biasing prevents accidental disengagement of the latch 54 and imparts sufficient force on the upper cover portion 18 through the catch 68 to keep the upper cover portion 18 and lower tray portion 20 of the cowling tightly sealed.

To remove the upper cover portion 18 from the lower tray portion 20, a user inserts his hand under the latch handle 58 and into the lower tray recess 42. The user then pulls the latch handle 58 so that the latch 54 rotates about the horizontal shaft 46. In turn, the latch hook 56 is rotated away from the catch hook 74 eliminating any interference between the latch 54 and the catch 68. When the latch 54 is rotated to a point where the latch hook 56 will not interfere with the catch hook 74, the biasing means forces the latch hook 56 to the disengaged position preventing the latch 56 from accidentally engaging or interfering with removal or connection of the upper cover portion 18 and lower tray portion 20. Once disengaged, the upper cover portion 18 of the cowling may be freely removed without any interference.

The foregoing descriptions, represent merely exemplary embodiments of the invention which are highly effective in retaining the upper cover portion and the lower tray portion of a protective cowling and concealing the latch assemblies of an outboard motor. Various changes and modifications may be made without departing from the spirit and scope of the invention, as defined by the appended claims.

What is claimed is:

1. A latching assembly for engaging and disengaging an upper cover portion of a cowling and a lower tray portion of a cowling of an outboard engine, wherein one of said cowling portions includes a recess, said latching assembly comprising a shaft mounted to one of said cowling portions, a latch rotatably secured to said shaft and movable between an engaged and a disengaged position, said latch including a latch handle and a latch hook, said latch handle disposed within said recess when engaged so that it is flush with the exterior of said cowling, a catch mounted to said other cowling portion and engageable by said latch hook, and means for biasing said latch to said engaged or disengaged position so as to yieldably retain said latch in said position.

2. The latching assembly of claim 1, wherein said means for biasing includes a helical spring connecting said latch hook to said lower tray portion so as to cause a greater spring tension force when said latch is positioned intermediate said engaged and disengaged positions forcing said latch to an engaged or disengaged position.

3. The latching assembly of claim 1, wherein said latch is rotatably secured within said lower tray portion.

4. A latching assembly for engaging and disengaging an upper cover portion of a cowling and a lower tray portion of a cowling of an outboard engine, wherein one of said cowling portions includes a recess, said latching assembly comprising a shaft mounted to said cowling portion having a recess, a latch rotatably secured to said shaft within said lower tray portion and movable between an engaged and a disengaged position, said latch including a latch handle connected to a latch hook by a latch arm, said latch handle being disposed within said recess when engaged so that it is flush with the exterior of said cowling, said latch hook having a generally L-shaped extended configuration, said latch arm having a stopper extending therefrom for preventing rotation of the latch beyond a fully engaged position, a catch mounted to said other cowling portion and engageable by said latch hook, and means for biasing said latch to said engaged or disengaged position so as to yieldably retain said latch in said position.

5. The latching assembly of claim 4, wherein said latch rotates about said shaft at the junction of said latch hook and arm.

6. The latching assembly of claim 1, wherein said catch is mounted to the inside of said upper tray portion.

7. The latching assembly of claim 6, wherein said catch includes a generally J-shaped hook engageable with said latch hook.

8. A cowl assembly for enclosing an internal combustion engine of an outboard motor comprising an upper cover portion, a lower tray portion including a recess, and at least one latching assembly for engaging and disengaging said upper cover and lower tray portions comprising a shaft mounted to one of said cowling portions, a latch rotatably secured to said shaft and movable between an engaged and a disengaged position, said latch including a latch handle and a latch hook, said latch handle disposed within said recess when engaged so that it is flush with the exterior of said cowling, a catch mounted to said other cowling portion and engageable with said latch hook, and means for biasing said latch to said engaged or disengaged position so as to yieldable retain said latch in said position.

9. A cowl assembly for enclosing an internal combustion engine of an outboard motor comprising an upper cover portion and a lower tray portion having a front face, a near face and opposite sides, a pair of rounded areas respectively provided at the merger of said opposite sides and rear face, said upper cover portion and lower tray portion including three recesses and corresponding latching assemblies near the junction of said upper cover and lower tray portions for engaging and disengaging said upper cover and lower tray portion, two of said latching assemblies provided at said respective pair of rounded areas and the other latching assembly provided near the center of said front face, each of said latching assemblies including a shaft mounted to said lower tray portion, a latch rotatably secured to said shaft and movable between an engaged and a disengaged position, said latch including a latch handle connected to a latch hook by a latch arm, said latch handle respectively disposed within said recess when engaged so that it is flush with the exterior of said cowling, a catch mounted to said upper cover portion and engageable with said latch hook, and means for biasing said latch to said engaged and disengaged position for preventing said latch from accidentally moving from said engaged or disengaged position.

10. The cowl assembly of claim 9, wherein said means for biasing includes a helical spring connecting said latch hook to said lower tray portion so as to cause a greater spring tension force when said latch is positioned intermediate said engaged and disengaged positions forcing said latch to an engaged or disengaged position.

11. A cowl assembly for enclosing an internal combustion engine of an outboard motor comprising an upper cover portion and a lower tray portion having a front face, a rear face and opposite sides, said upper cover portion and lower tray portion including three recesses and corresponding latching assemblies near the junction of said upper cover and lower tray portions for engaging and disengaging said upper cover and lower tray portion, two of said latching assemblies provided at the merger of said sides and rear face and the other latching assembly provided near the center of said front face, each of said latching assemblies including a shaft mounted to said lower tray portion, a latch rotatably secured to said shaft and movable between an engaged and a disengaged position, said latch including a latch handle connected to a latch hook by a latch arm, said latch handle respectively disposed within said recess when engaged so that it is flush with the exterior of said cowling, said latch hook having a generally L-shaped extended configuration, said latch arm including a stopper extending therefrom for preventing rotation of the latch beyond a fully engaged position, a catch mounted to said upper cover portion and engageable with said latch hook, a helical spring connecting said latch hook to said lower tray portion which biases said latch to said engaged and disengaged position for preventing said latch from accidentally moving from said engaged or disengaged position, and said spring configured so as to cause a greater spring tension force when said latch is positioned intermediate said engaged and disengaged positions, forcing said latch to an engaged or disengaged position.

12. The cowl assembly of claim 11, wherein said latch rotates about said shaft at the junction of said latch hook and arm.

13. The cowl assembly of claim 8, wherein when said latch is in said engaged position, the shape of said handle is coextensive with the shape of said recess.

14. The cowl assembly of claim 8, wherein said handle pivots about a single axis.

15. The cowl assembly of claim 8, wherein said biasing means releasably restrains said handle in said engaged position so that the handle is flush with the exterior of said cowling or said disengaged position so that the handle is not flush with the exterior of said cowling.

* * * * *

UNITED STATES PATENT AND TRADEMARK OFFICE

CERTIFICATE OF CORRECTION

PATENT NO. : 5,803,777

DATED : September 8, 1998

INVENTOR(S) : Noriyoshi Hiraoka

It is certified that error appears in the above-identified patent and that said Letters Patent is hereby corrected as shown below:

In Claim 9, col. 5, line 41, "a near face" should be --a rear face--.

Signed and Sealed this

Second Day of March, 1999

*Attest:*

*Attesting Officer*

Q. TODD DICKINSON

*Acting Commissioner of Patents and Trademarks*